US012379184B2

(12) United States Patent
McKendrick et al.

(10) Patent No.: US 12,379,184 B2
(45) Date of Patent: Aug. 5, 2025

(54) TRIGGER GUARD STABILIZER

(71) Applicant: Safariland, LLC, Jacksonville, FL (US)

(72) Inventors: Matthew E. McKendrick, Jacksonville, FL (US); James H. Radney, Jacksonville, FL (US); Robert DeRenzo, Saint Johns, FL (US)

(73) Assignee: Safariland, LLC, Jacksonville, FL (US)

( * ) Notice: Subject to any disclaimer, the term of this patent is extended or adjusted under 35 U.S.C. 154(b) by 91 days.

(21) Appl. No.: 18/112,641

(22) Filed: Feb. 22, 2023

(65) Prior Publication Data

US 2023/0266099 A1 Aug. 24, 2023

Related U.S. Application Data

(60) Provisional application No. 63/312,594, filed on Feb. 22, 2022.

(51) Int. Cl.
*F41C 33/02* (2006.01)

(52) U.S. Cl.
CPC ..... *F41C 33/0209* (2013.01); *F41C 33/0254* (2013.01); *F41C 33/0263* (2013.01)

(58) Field of Classification Search
CPC ..... F41C 33/0209; F41C 33/0254; F41C 33/0263
See application file for complete search history.

(56) References Cited

U.S. PATENT DOCUMENTS

| | | | | |
|---|---|---|---|---|
| 2,051,844 | A * | 8/1936 | Green | F41C 33/0263 D3/222 |
| 3,252,639 | A * | 5/1966 | Sloan | F41C 33/0227 224/911 |
| 5,284,281 | A * | 2/1994 | Nichols | F41C 33/0263 224/244 |
| 5,944,239 | A * | 8/1999 | Rogers | F41C 33/0209 224/193 |
| 6,769,581 | B2 | 8/2004 | Rogers et al. | |
| 9,494,384 | B2 | 11/2016 | Rogers et al. | |
| 10,451,382 | B2 * | 10/2019 | Yeates | F41C 33/0263 |
| 11,421,958 | B1 * | 8/2022 | Rogers | F41C 33/041 |
| 11,536,550 | B1 * | 12/2022 | Smith | F42B 39/02 |
| 2011/0174848 | A1 | 7/2011 | Kirsch | |
| 2012/0223110 | A1 | 9/2012 | Gregory et al. | |
| 2014/0042196 | A1 | 2/2014 | Pellegrini | |
| 2020/0240744 | A1 * | 7/2020 | Rogers | F41C 33/0227 |

OTHER PUBLICATIONS

PCT Application No. PCT/US23/13610—PCT International Search Report and Written Opinion dated May 3, 2023.

* cited by examiner

*Primary Examiner* — Derek J Battisti
(74) *Attorney, Agent, or Firm* — Kane Kessler, P.C.; Paul E. Szabo

(57) ABSTRACT

A trigger guard stabilizer for a holster provides trigger guard side-to-side support. Because the trigger guard stabilizer is spring-loaded, and can be depressed into a receiving pocket, it automatically moves downward out of the way if a taller light passes over the stabilizer top during a holstering action. Once the light has passed over the stabilizer, the stabilizer springs back into a position with portions that extend on either side of the trigger guard. This helps to hold the trigger guard centered laterally in the holster, thus impeding unwanted access to the trigger.

8 Claims, 8 Drawing Sheets

TRIGGER GUARD STABILIZER

RELATED APPLICATION

This application claims the benefit of the filing date of U.S. Provisional Application No. 63/312,594, filed Feb. 22, 2022, the entire disclosure of which is incorporated herein.

BACKGROUND OF THE INVENTION

A holster for a handgun or other weapon, such as an electric discharge weapon, is preferably configured to fit the weapon so as to minimize movement of the holstered weapon within the holster, and to block unwanted access to the trigger. Thus, the holster is designed to fit the weapon closely.

Some holsterable handguns and other weapons, such as electric discharge weapons, can optionally have a light mounted under the barrel. The light typically extends downward from the barrel and occupies a significant amount of space in the holster. The light is always wider than the weapon's trigger guard, and often projects downward farther than the trigger guard. As such, the lower portion of the holster must be wider and taller than the trigger guard, to accommodate the light.

If that results in extra space on either side of the trigger guard. the trigger guard can be pushed side to side, which can make the security locking devices of the holster easier to defeat and open up ingress areas around the trigger guard which can allow objects to contact the trigger and potentially discharge the weapon.

SUMMARY OF THE INVENTION

The present invention provides a trigger guard stabilizer that provides trigger guard side-to-side support. Because the trigger guard stabilizer is spring-loaded, and can be depressed into a receiving pocket, it automatically moves downward out of the way if a taller light passes over the stabilizer top during a holstering action. Once the light has passed over the trigger guard stabilizer, the trigger guard stabilizer springs back into place around the trigger guard. The stabilizer has portions that extend on either side of the trigger guard. This helps to hold the trigger guard centered laterally in the holster, thus impeding unwanted access to the trigger.

This mechanism prevents unwanted twist movements of the weapon, keeping the weapon in the desired location and orientation in the holster and reducing the possibility of access to the trigger.

In one embodiment, the invention relates to a holster for a handgun having a trigger guard, the holster comprising a holster body having a plurality of walls including a top wall and an opposite bottom wall, the plurality of walls together defining a chamber in the holster body for receiving a portion of the handgun. The holster body has an entranceway enabling insertion of the handgun into the holster chamber in an insertion direction and enabling removal of the handgun from the holster chamber in an opposite removal direction. A trigger guard stabilizer is supported in a pocket in the bottom wall for movement relative to the bottom wall in a direction between the bottom wall and the top wall. A spring in the pocket acts between the stabilizer and the bottom wall of the holster, the spring biasing the stabilizer toward the top wall. The stabilizer has a generally U-shaped configuration with side walls configured to extend on opposite sides of a handgun trigger guard when a handgun is in the holster thereby to resist lateral movement of the trigger guard within the holster chamber.

DESCRIPTION OF AN EMBODIMENT OF THE INVENTION

The present invention relates to a trigger guard stabilizer for a handgun holster. The invention is applicable to handgun holsters of varying configurations. As representative of the invention, FIGS. 1-8 drawings illustrate a handgun holster 10 that is a first embodiment of the invention. The invention is not limited to the illustrated embodiment.

The holster 10 is configured for use with a handgun assembly 11 that includes a handgun 12 (FIGS. 5-8) having a trigger guard 20. A holster in accordance with the present invention could be configured for use with a different type or style of handgun.

Figure 5:
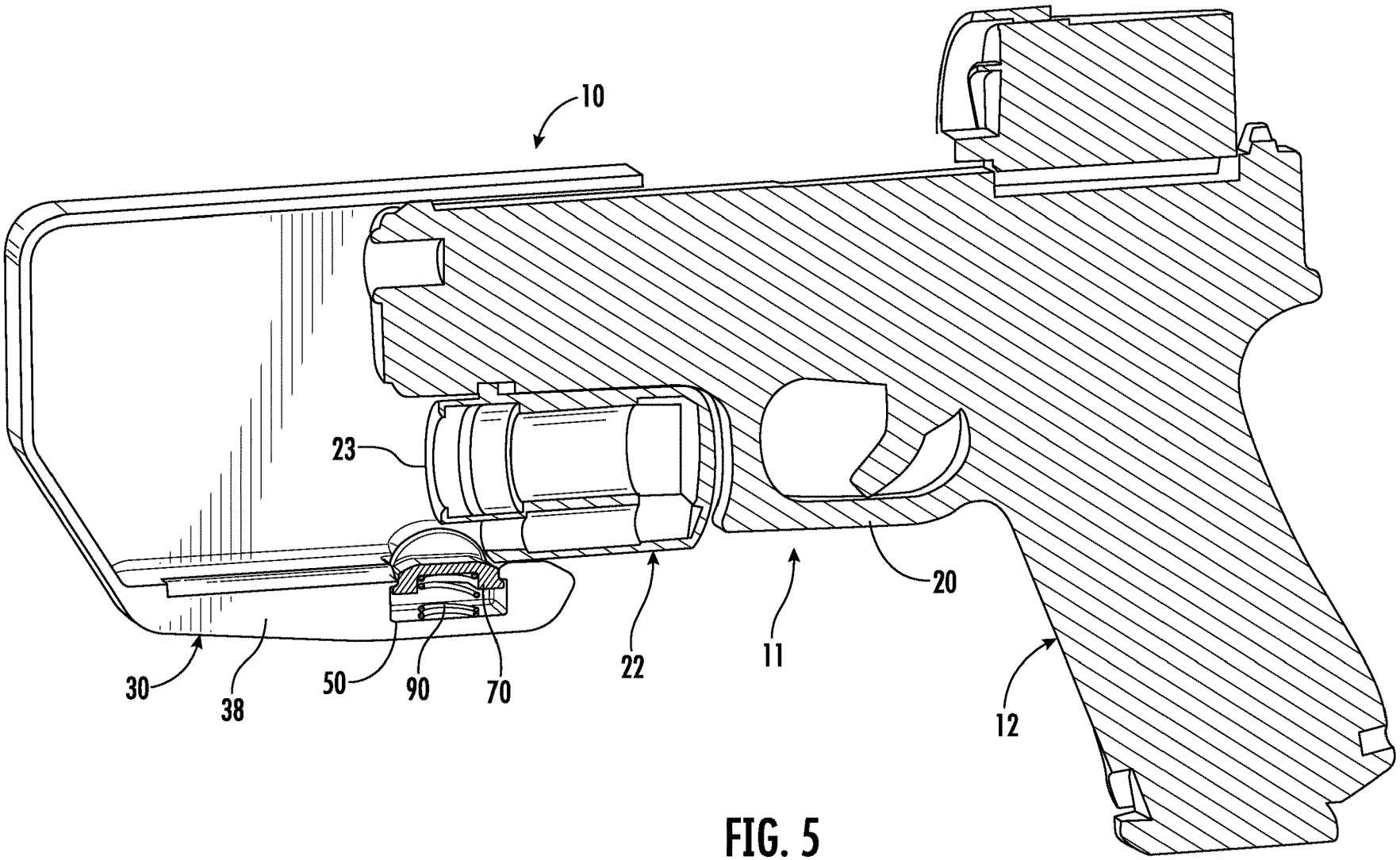
FIG. 5 is a view showing a handgun assembly in a position being inserted into the holster, prior to engagement of the handgun assembly with the stabilizer.

For convenience in this specification, the directional terms "up", "down", "forward", and "rearward" are used to indicate directions as seen with reference to FIG. 5 of the attached drawings. Thus, as one example, "upward" refers to a direction from the trigger guard 20 (at the bottom of the holster) toward the top of the holster. As another example, "forward" refers to a direction of insertion of the handgun into the holster; and "rearward" is in the handgun removal direction. Obviously, if the holster and handgun are in a different orientation in space, these directions would be different. Also, the term "handgun assembly" as used herein can mean the handgun alone, when appropriate.

The handgun assembly 11 includes a light 22 (FIG. 5) that is mounted on the handgun 12, in a position below the barrel 16. The light 22 has a forward end portion 23. The light 22 is tall enough so that it extends down below the trigger guard 20. As a result, the handgun assembly 11 is taller (in an up and down direction as viewed in FIG. 5) at the location of the light 22, than it is at the location of the trigger guard 20. In addition, the light 22 is substantially wider than the trigger guard 20.

The holster 10 (FIGS. 1 and 5) includes generally a holster body 30 having a cavity or pocket 50; a stabilizer 70 that is movably positioned in the pocket 50; and a spring 90 that provides a biasing force between the holster body 30 and the stabilizer 70.

The holster body 30 as illustrated is a clamshell type holster body of the type that is shown for example in U.S. Pat. No. 9,494,384, the disclosure of which is hereby incorporated by reference. As such, the holster body 30 is molded in one piece, with a living hinge at the top of the holster body, and with the two holster sides being folded down to join each other at their bottom edges. This method of formation of the holster body 30 allows for the stabilizer 70 to be captured at the bottom of the holster body, in the pocket 50, for operation as described below. Other types of holster bodies may be usable. For example, a holster body that is not a clamshell could includes a pocket with a cap, on either the bottom of the holster or the side of the holster.

The holster body 30 includes two side walls 32 and 34; a top wall 36; a bottom wall 38; and an end wall 40. The holster walls define a chamber 42 for receiving the handgun 12. The end of the holster body 30 opposite from the end wall 40 has an opening or entranceway 41 (FIG. 1) through which the handgun 12 is inserted into the chamber 42, in a forward or an insertion direction 46 that is to the left as viewed in FIG. 5 or into the plane of the paper as viewed in FIG. 8. The handgun 12 is removed from the chamber 42 in an opposite rearward or removal direction 48 (in a direction to the right as viewed in FIGS. 1 and 5). The holster side walls 32 and 34 are wide enough to accommodate both the handgun 12 itself, and the light 22. The chamber 42 is wide enough along its entire length to accommodate the light 22, and therefore is substantially wider than is necessary to accommodate the trigger guard 20.

Figure 1:
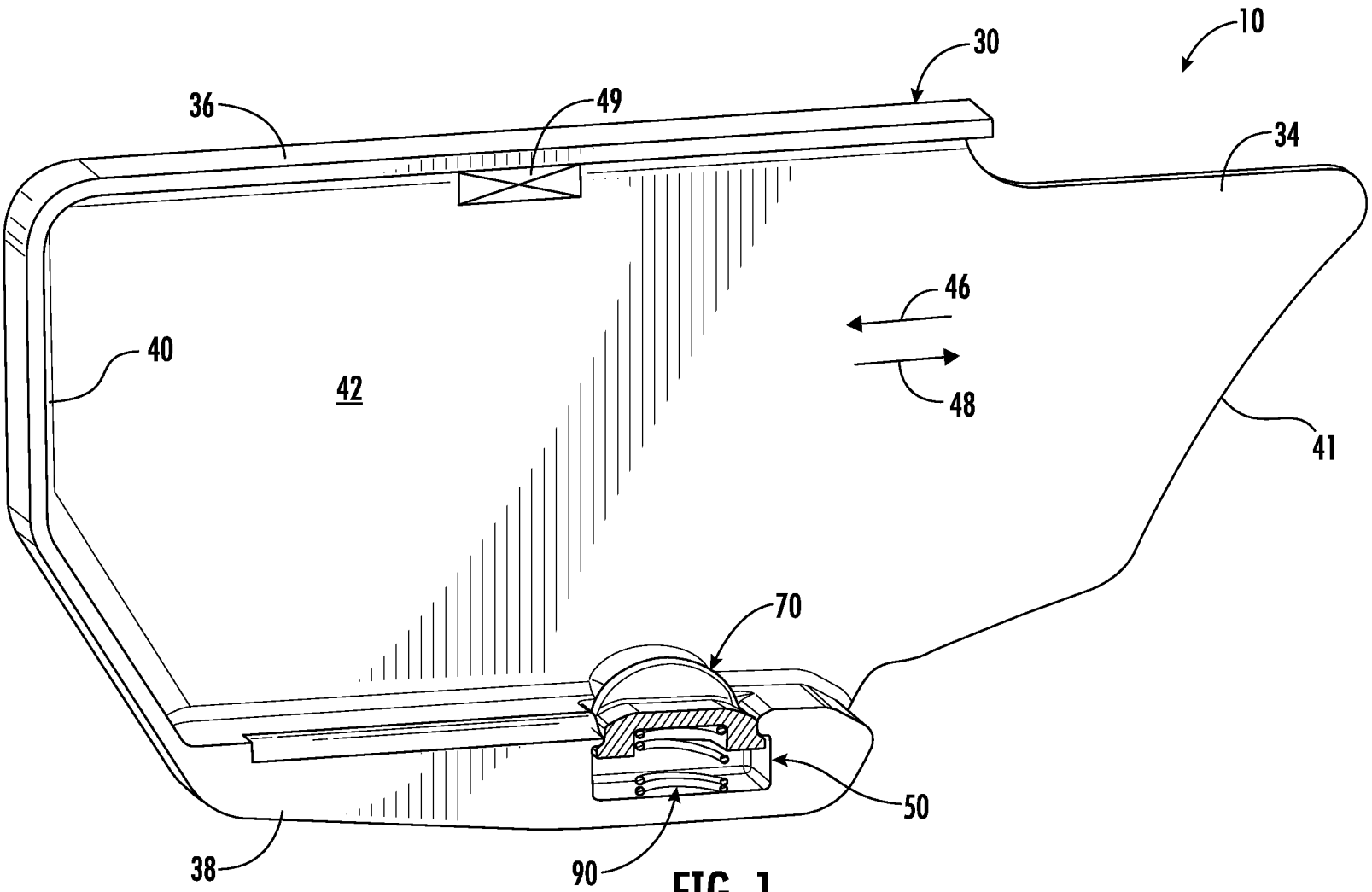
FIG. 1 is a perspective view of a portion of holster that is a first embodiment of the invention, the holster including a holster body and a stabilizer in accordance with the invention.
Figure 2:
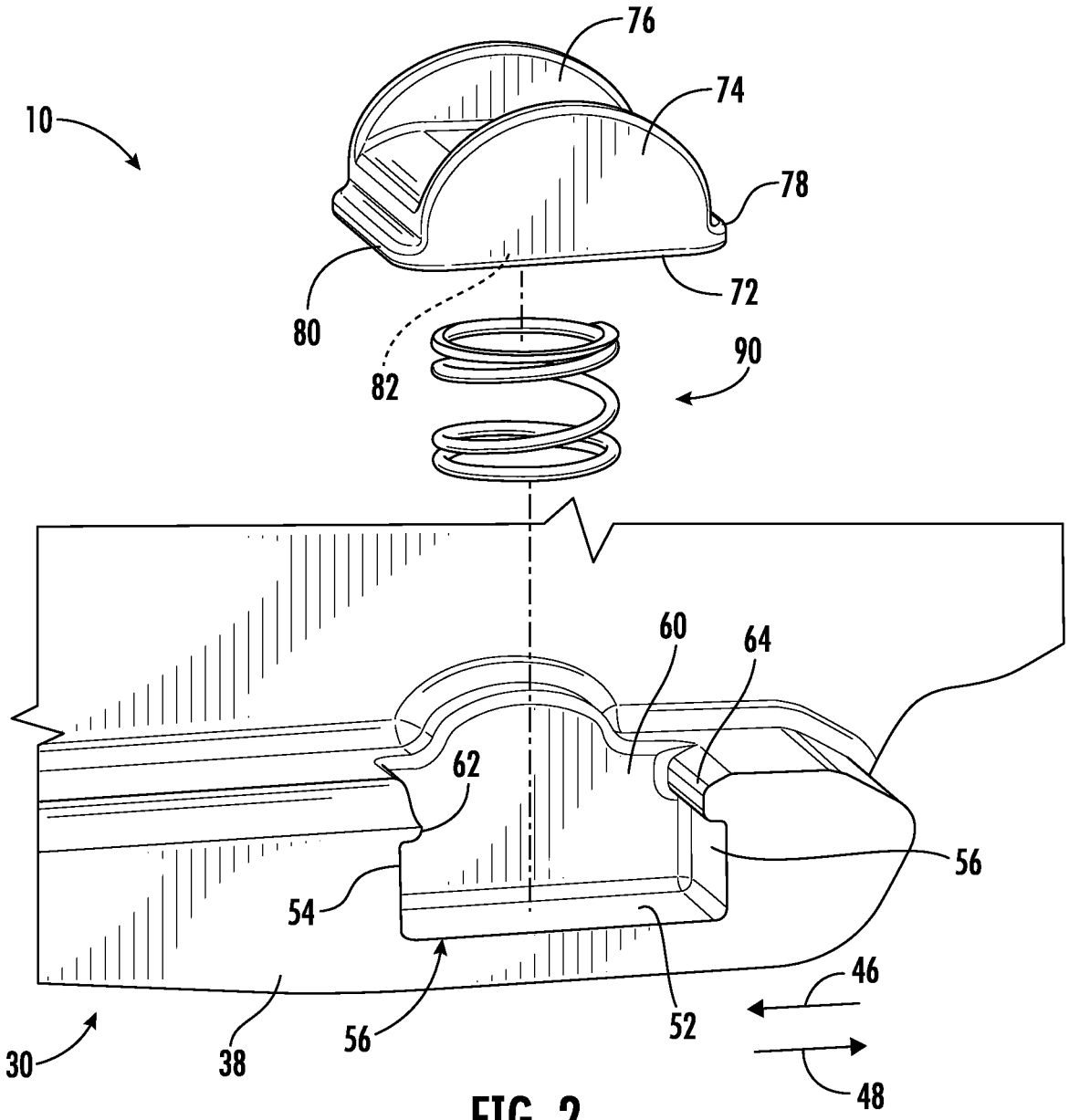
FIG. 2 is an enlarged, exploded view of parts the holster of FIG. 1, including the stabilizer.
Figure 8:
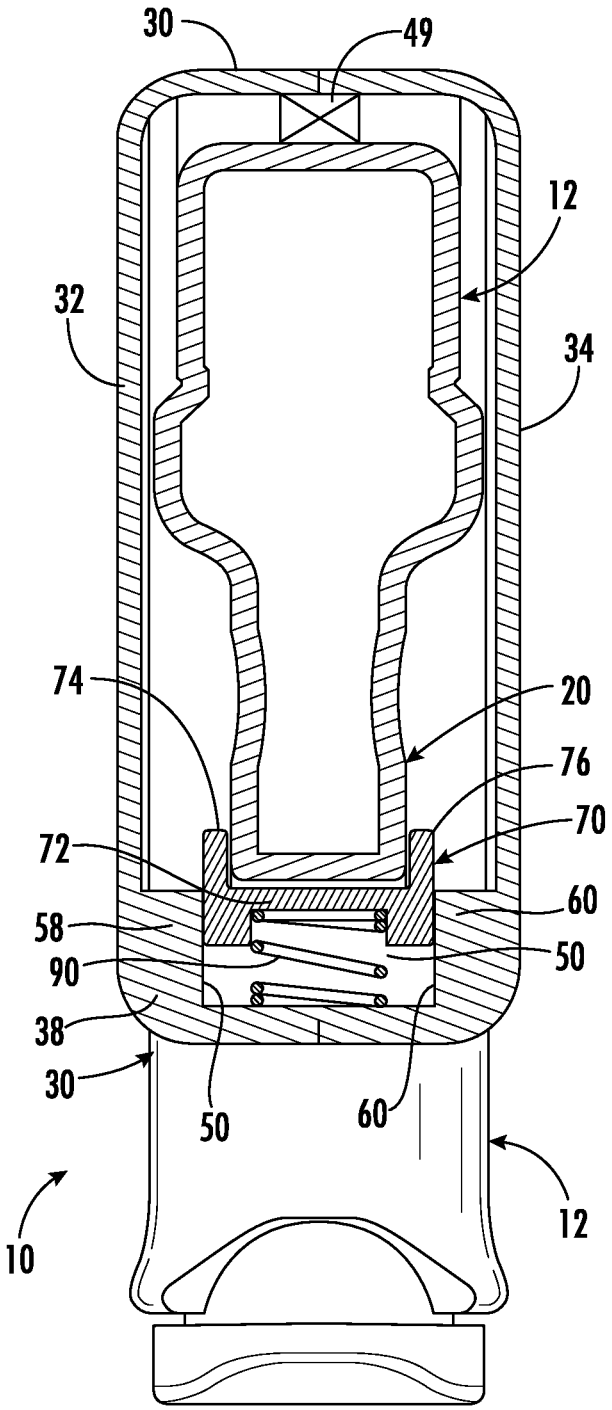
FIG. 8 is a cutaway end view of the holster and handgun assembly when in the fully inserted position of FIG. 7.

In the illustrated holster 10, the holster top wall 30 and the side walls 28 and 29, together, support a handgun locking mechanism indicated schematically at 49 in FIGS. 1 and 8, which may be for example of the type shown in U.S. Pat. No. 6,769,581. This locking mechanism 49 engages the handgun 12 adjacent its ejection port, and helps to prevent inadvertent or unwanted removal of the handgun from the holster 10. For the handgun locking mechanism 49 to function properly, the handgun 12 should be pressed upward in the holster body 30 thereby to operatively engage the handgun locking mechanism. The present invention, although directed to trigger guard stabilization, might also assist in that function.

The pocket 50 is formed in the bottom wall 38 of the holster body 30, to capture and retain the stabilizer 70. The pocket 50 is a generally rectangular, five sided cavity in the bottom wall 38, opening upward into the chamber 42. The dimensions of the pocket 50 are selected so that the stabilizer 70 can be fitted into the pocket during assembly of the holster body 30, along with the spring 90, with the stabilizer thereafter being movable in the holster body in a manner as described below. The pocket 50 is centered laterally on the holster body bottom wall 38.

The bottom of the pocket 50 is defined by a bottom wall surface 52 of the holster body 30. The front and back of the pocket 50 are defined by respective front and back walls or surfaces 54 and 56 that extend generally vertically in the holster body 30. The left and right sides of the pocket 50 are defined by respective left and right side walls or surfaces 58 and 60 that extend generally vertically in the holster body 30, between the front and back walls 54 and 56. At the top of the front wall 54 of the pocket 50 is a lip 62 that projects rearward into the pocket, toward the back wall 56. Similarly, at the top of the back wall 56 of the pocket 50 is a lip 64 that projects forward into the pocket, toward the front wall 54.

The stabilizer 70, as illustrated, is an element that is formed separately from and is movable relative to the holster body 30. The stabilizer 70 has a generally U-shaped configuration as viewed from the front or back, including a bottom wall 72 and two upstanding side walls 74 and 76. The back edge 78 of the stabilizer bottom wall 72, and the front edge 80 of the stabilizer bottom wall 74, may be angled or ramped, as illustrated, to facilitate insertion and removal of the handgun assembly 11. The back edge 78 and the front edge 80 may be configured to work with a particular handgun, and may be configured differently from each other as appropriate. The dimensions of the stabilizer 70 are selected so that the stabilizer is captured within the pocket 50, but is still movable up and down within the pocket, relative to the holster body 30 itself.

The spring 90 as illustrated is a coil spring. Other forms of springs or biasing means may, alternatively, be provided, perhaps even integrally with the stabilizer 70. A spring pocket 82 is formed on the underside of the bottom wall of the stabilizer 70 and receives an upper end 92 of the spring 90.

Figure 3:
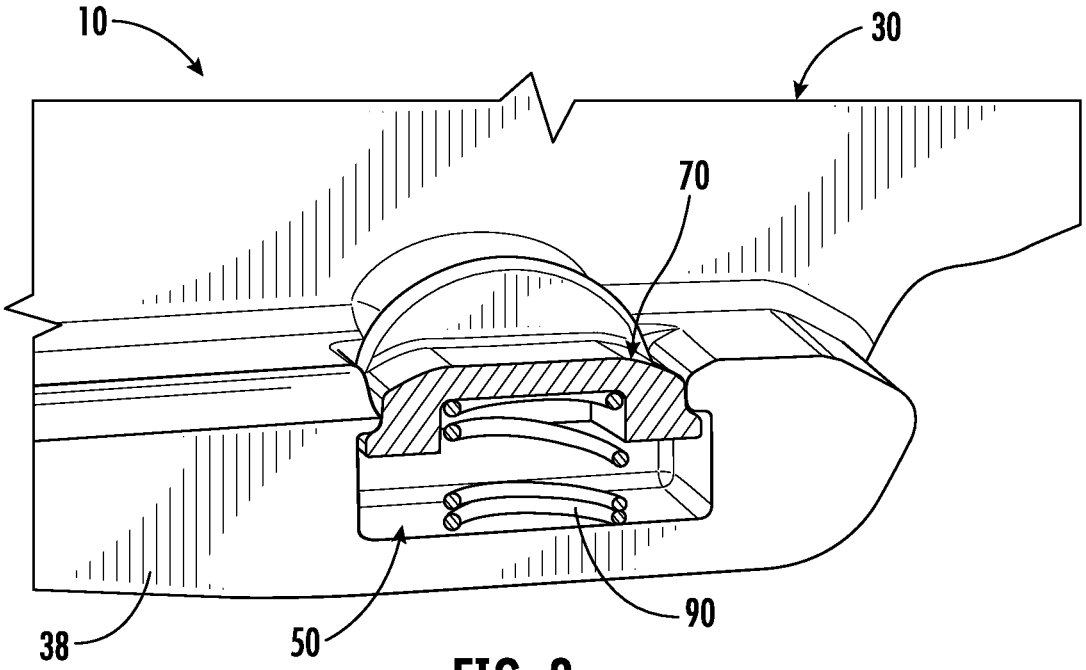
FIG. 3 is a view similar to FIG. 2 showing the parts in an assembled condition and in a free state.
Figure 4:
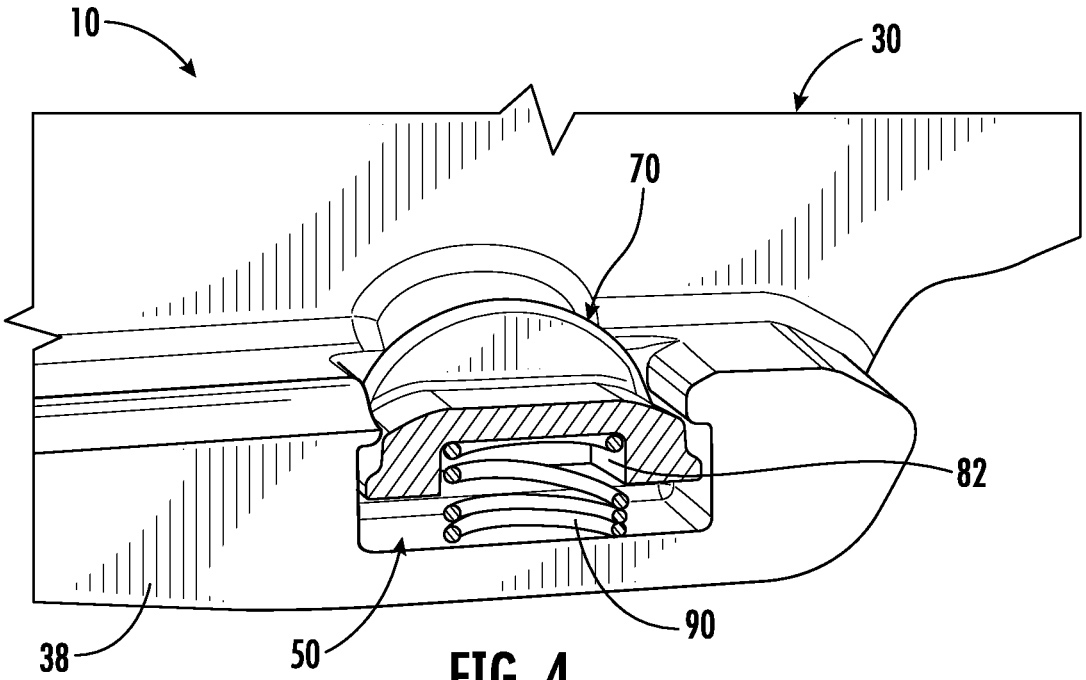
FIG. 4 is a view similar to FIG. 3 but showing the parts in an engaged or lowered position.

FIGS. 1 and 3 illustrate the holster 10 with the trigger guard stabilizer in a free state, for example, when the handgun assembly 11 is not inserted in the holster. The stabilizer 70 is biased upward by the spring 90. The bottom wall 74 of the stabilizer 70 engages the front and back lips 62 and 64 at the opposite ends of the pocket 50. This engagement blocks further upward movement of the stabilizer 70 relative to the holster body 30, retaining the stabilizer in the pocket 50. In this position, the stabilizer 70 is at its highest or most upward position of movement. The side walls 58 and 60 of the pocket 50 block the stabilizer 70 from moving laterally. Because the pocket 50 is centered laterally on the holster bottom wall 38, the stabilizer 70 also is centered laterally on the holster bottom wall.

Figure 6:
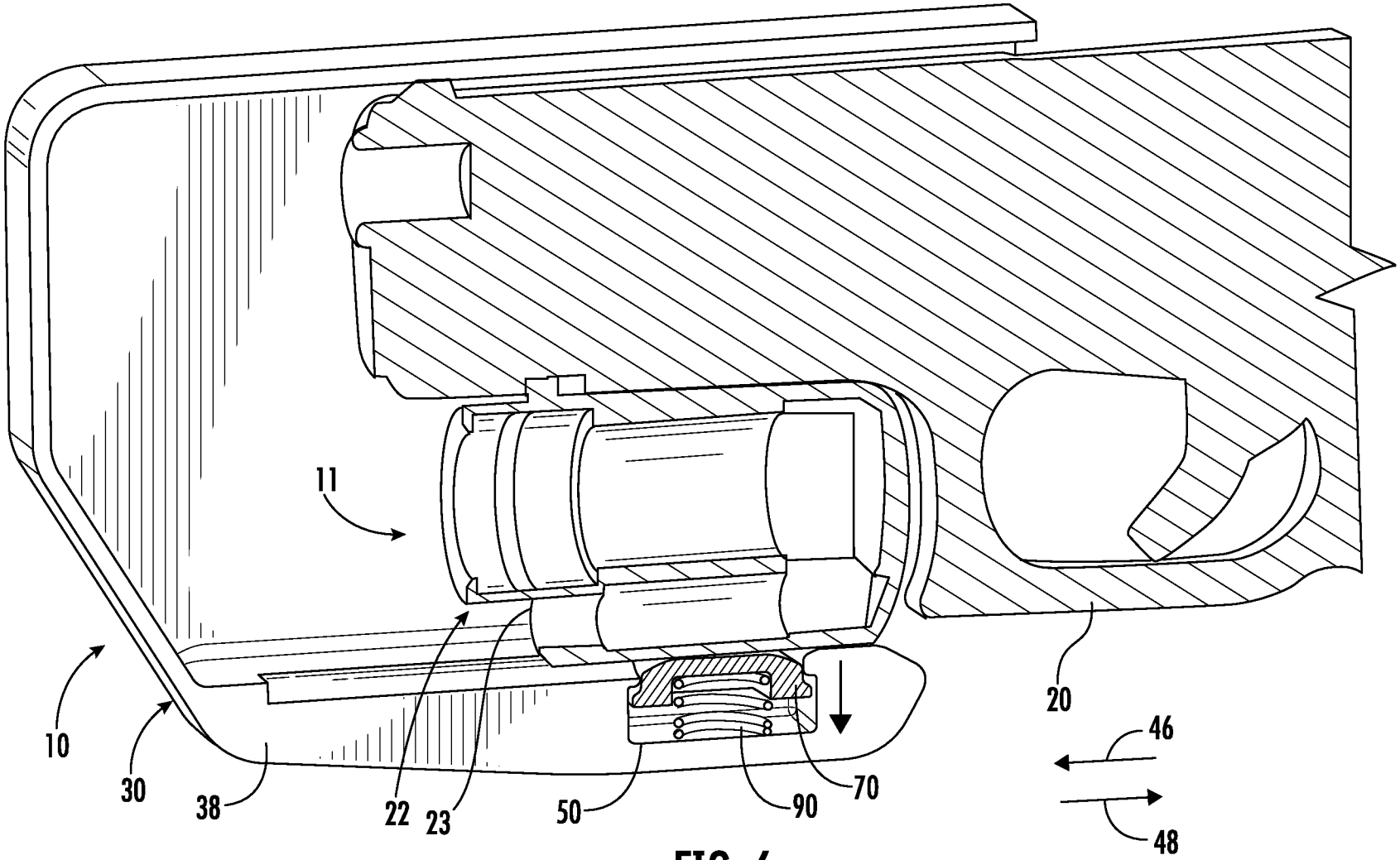
FIG. 6 is a view similar to FIG. 5 showing the handgun assembly in a position further inserted into the holster, with a light that is part of the handgun assembly pressing the stabilizer into the lowered condition.
Figure 7:
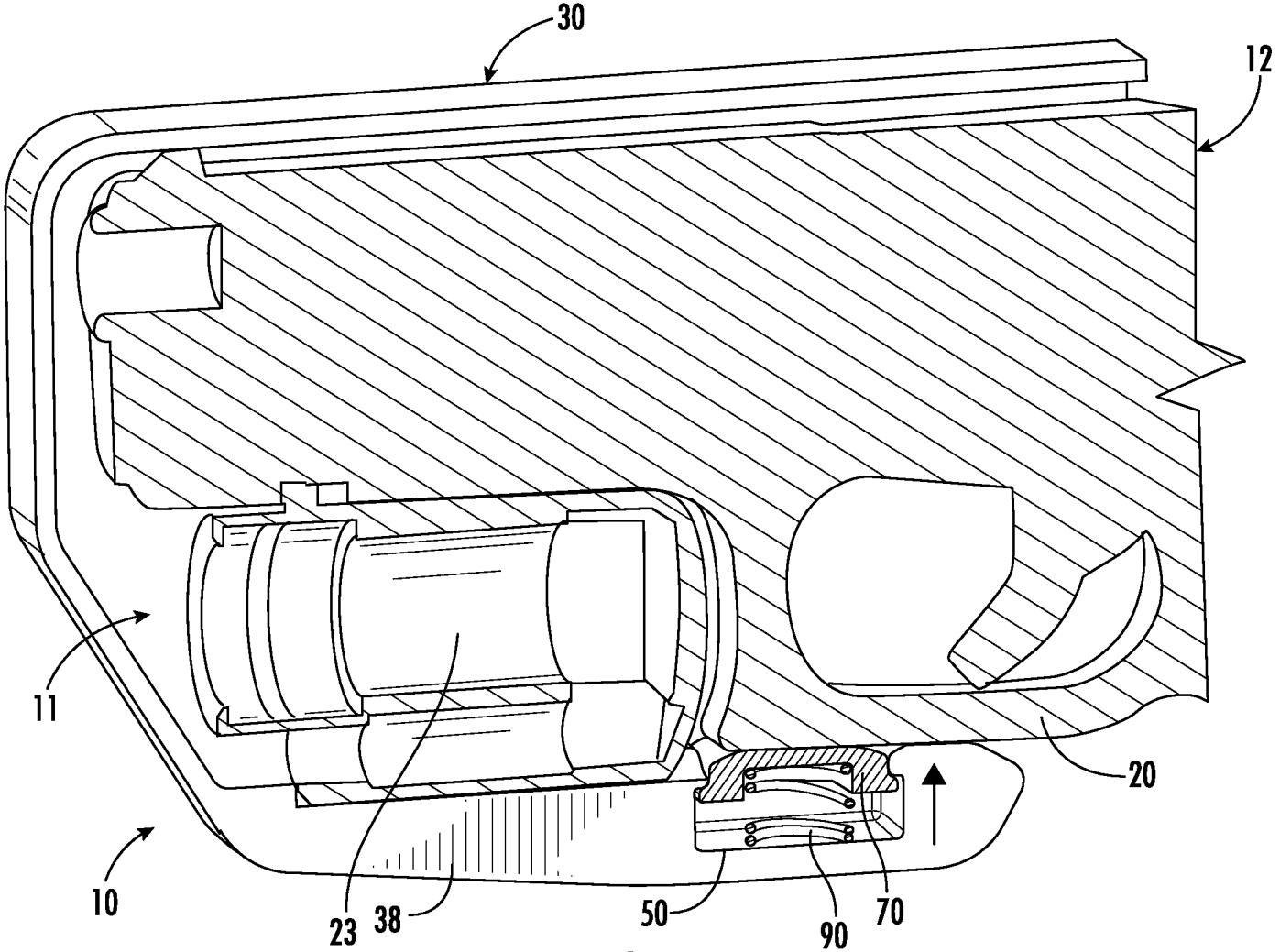
FIG. 7 is a view similar to FIG. 6 showing the handgun assembly in a position after being fully inserted into the holster, with the trigger guard engaging the stabilizer.

FIGS. 5-7 illustrate steps in the process of insertion of the handgun assembly 11 into the holster 10. In FIG. 5, the handgun assembly 11 has been inserted through the entranceway 44 into the chamber 43. The forward end portion 23 of the light 22 first engages the stabilizer 70. This engagement may occur along the bottom wall of the stabilizer 70, or along the side walls of the stabilizer, or both. The stabilizer 70 is still at its highest position (closest to the top wall 30 of the holster 10) within its range of movement, when this engagement commences.

As the handgun assembly 11 is inserted farther into the chamber 42 of the holster 10, the light 22 pushes the stabilizer 70 downward against the bias of the spring 90. When the light 22 is fully over the stabilizer 70, the stabilizer is at a lower position within its range of movement relative to the holster body 30.

As the handgun assembly 11 moves still farther into the chamber 42 of the holster 10, the light 22 moves forward past the stabilizer 70, and the trigger guard 20 moves forward into a position over the stabilizer. As this forward movement occurs, and because the trigger guard 20 is shorter (higher) vertically than the light 22, the stabilizer 70 moves into an upper position, under the influence of the spring 90, in a direction toward the top wall 36 of the holster body 30. The stabilizer 70 does not move laterally by any significant distance, and does not move longitudinally (forward and backward) by any significant distance, because it is constrained by the walls of the pocket 50, while it moves upward in int range of movement. The top to bottom range of movement of the stabilizer 70 is selected to account for the distance that the light 22 project farther downward than the trigger guard 20.

When the handgun assembly 11 is fully inserted into the chamber 42 of the holster 10 (FIG. 7), the stabilizer 70 assumes fully the engaged or stabilizing position shown in FIGS. 7 and 8. In this upper position, the bottom wall 72 of the stabilizer 70 is pressed upward into engagement with the underside of the trigger guard 20, but the spring 90. The side walls 74 and 76 of the stabilizer 70 extend upward from the bottom wall 72, on either side of the trigger guard 20. At the same time, the side walls 74 and 76 of the stabilizer 70 lie against the side walls 58 and 60 of the pocket 50, thus blocking lateral movement of the stabilizer in the holster body 30.

Because the stabilizer 70 cannot move laterally in the holster body 30, and the side walls 74 and 76 capture the trigger guard 20, the stabilizer blocks lateral movement of the trigger guard in the holster body. In this manner, the stabilizer 70 stabilizes the handgun 12 in the holster 10, even though the trigger guard 20 is sufficiently shorter than the light 22 that the trigger guard is unable to directly engage the bottom wall 38 of the holster body 30. This stabilizing effect is also beneficial because maintaining the trigger guard 20 centered laterally in the holster 10, reduces the possibility of unwanted access to the handgun trigger.

Figure 9:
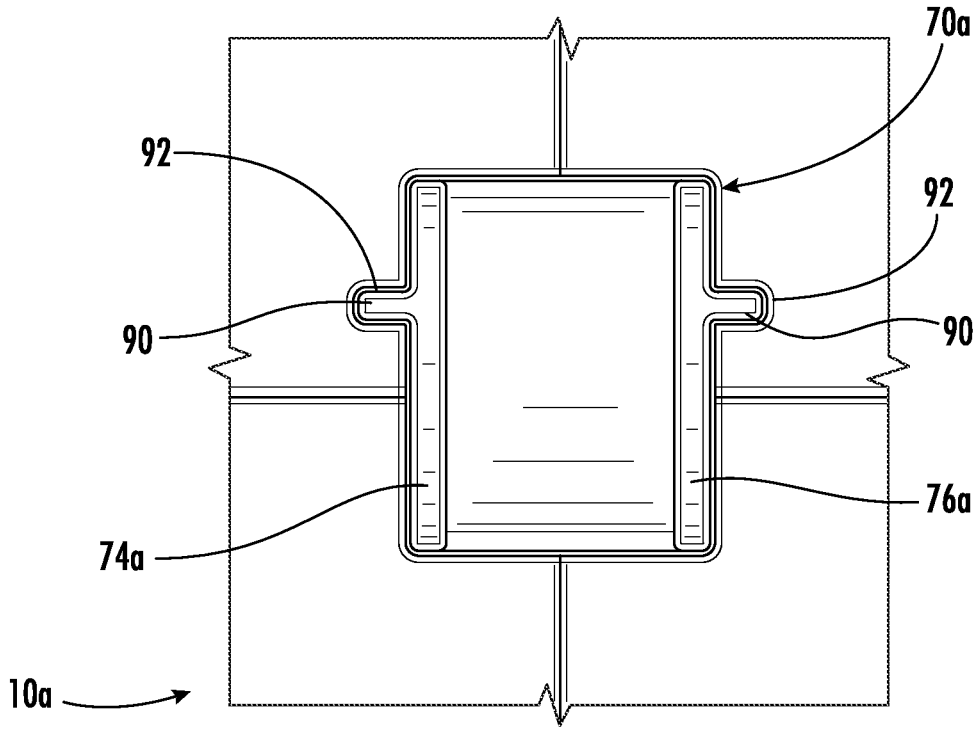
FIGS. 9 and 10 illustrate a portion of a holster with stabilizer that is a second embodiment of the invention.
Figure 10:
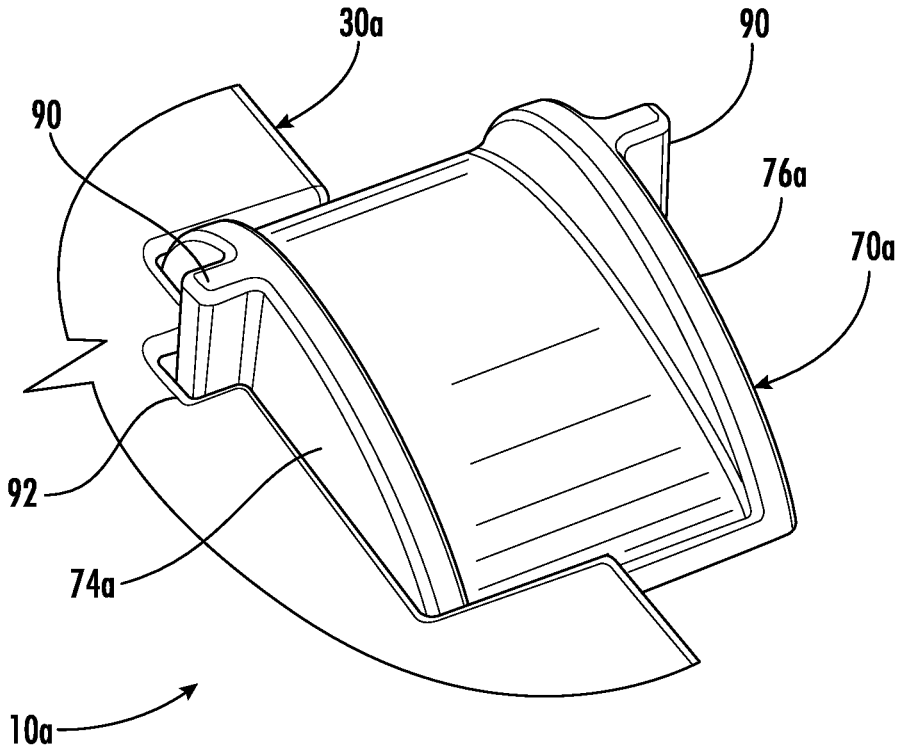

FIGS. 9 and 10 illustrate holster with trigger guard stabilizer that is a second embodiment of the invention. Parts that are the same or generally the same as in the first embodiment are give the same reference numerals, with the suffix "a" added to distinguish them.

The stabilizer 70*a* is generally similar to the stabilizer 70 but also includes guide ribs 90 on the laterally outer surfaces of the side walls 74*a* and 76*a*. The guide ribs 90 are received in vertically extending slots 92 in the holster bottom wall. The guide ribs 90 can help to prevent twisting (about a top to bottom axis) of the stabilizer 70*a* and thus the handgun in the holster 10*a*. In addition, the guide ribs 90 are offset (not centered) front to back on the stabilizer 70*a*. Therefore, the stabilizer 70*a* can be assembled correctly with the holster body 30*a* in only one orientation, which is beneficial because the stabilizer is not symmetrical front to back.

From the above description of the invention, those skilled in the art will perceive improvements, changes and modifications. Such improvements, changes and modifications within the skill of the art are intended to be covered by the appended claims.

The invention claimed is:

1. A holster for a handgun having a trigger guard, said holster comprising: a holster body having a plurality of walls including a top wall and an opposite bottom wall, said plurality of walls together defining a chamber in said holster body for receiving a portion of the handgun; said holster body having an entranceway enabling insertion of the handgun into said holster chamber in an insertion direction and enabling removal of the handgun from said holster chamber in an opposite removal direction; said bottom wall having surfaces defining a pocket in said bottom wall, said surfaces including front, back, left, and right walls; a trigger guard stabilizer supported in said pocket in said bottom wall for movement relative to said bottom wall in a direction between said bottom wall and said top wall but blocked from movement in a lateral direction and also blocked from movement in a forward and rearward direction by said surfaces of said pocket; and a spring in said pocket, said spring acting between said stabilizer and said bottom wall of said holster, said spring biasing said stabilizer toward said top wall; wherein said stabilizer has side walls configured to extend on opposite sides of a handgun trigger guard when a handgun is in said holster thereby to resist lateral movement of the trigger guard within said holster chamber.

2. A holster as set forth in claim 1 wherein said stabilizer has a generally U-shaped configuration with side walls configured to extend on opposite sides of a handgun trigger guard when a handgun is in said holster thereby to resist lateral movement of the trigger guard within said holster chamber.

3. A holster as set forth in claim 1 wherein said stabilizer includes guide ribs that engage in guide slots in the holster bottom wall.

4. A holster as set forth in claim 3 wherein said stabilizer has a bottom wall extending between said side walls and said spring acts between said stabilizer bottom wall and said holster bottom wall.

5. A holster as set forth in claim 1 wherein the dimensions of the stabilizer and the pocket are selected so that the stabilizer is captured within the pocket, but is still movable up and down within the pocket, relative to the holster body, during insertion and removal of a handgun.

6. A holster for a handgun having a trigger guard, said holster comprising: a holster body having a plurality of walls including a top wall and an opposite bottom wall, said plurality of walls together defining a chamber in said holster body for receiving a portion of the handgun; said holster body having an entranceway enabling insertion of the handgun into said holster chamber in an insertion direction and enabling removal of the handgun from said holster chamber in an opposite removal direction; a trigger guard stabilizer supported in a pocket in said bottom wall for movement relative to said bottom wall in a direction between said bottom wall and said top wall but blocked from movement in a lateral direction, said pocket being defined by surfaces including front, back, left, and right walls; and a spring in said pocket, said spring acting between said stabilizer and said bottom wall of said holster, said spring biasing said stabilizer toward said top wall; wherein said stabilizer includes guide ribs that engage in guide slots in the holster bottom wall.

7. A holster as set forth in claim 6 wherein said stabilizer has a generally U-shaped configuration with side walls configured to extend on opposite sides of a handgun trigger guard when a handgun is in said holster thereby to resist lateral movement of the trigger guard within said holster chamber.

8. A holster as set forth in claim 7 wherein said holster bottom wall includes front and back surfaces of said pocket that block said stabilizer from movement in a forward and rearward direction.

* * * * *